US008333566B2

(12) United States Patent
Dainez et al.

(10) Patent No.: US 8,333,566 B2
(45) Date of Patent: Dec. 18, 2012

(54) FLUID PUMP CONTROLLING SYSTEM, A FLUID PUMP CONTROLLING METHOD, A LINEAR COMPRESSOR AND A COOLER

(75) Inventors: Paulo Sérgio Dainez, Joinville-SC (BR); Egidio Berwanger, Joinville-SC (BR)

(73) Assignee: Whirlpool S.A., Sao Paulo (BR)

( * ) Notice: Subject to any disclaimer, the term of this patent is extended or adjusted under 35 U.S.C. 154(b) by 969 days.

(21) Appl. No.: 10/596,239

(22) PCT Filed: Dec. 2, 2004

(86) PCT No.: PCT/BR2004/000240

§ 371 (c)(1),
(2), (4) Date: Mar. 2, 2007

(87) PCT Pub. No.: WO2005/054676

PCT Pub. Date: Jun. 16, 2005

(65) Prior Publication Data

US 2007/0276544 A1 Nov. 29, 2007

(30) Foreign Application Priority Data

Dec. 5, 2003 (BR) ..... 0305458

(51) Int. Cl.
*F04B 49/06* (2006.01)
*F04B 35/04* (2006.01)

(52) U.S. Cl. ..... 417/44.1; 417/45; 417/53; 417/417

(58) Field of Classification Search ..... 417/44.1, 417/53, 417, 63, 415, 45
See application file for complete search history.

(56) References Cited

U.S. PATENT DOCUMENTS

| | | | | |
|---|---|---|---|---|
| 4,179,630 | A * | 12/1979 | Stuber | 310/15 |
| 4,502,842 | A * | 3/1985 | Currier et al. | 417/8 |
| 5,224,835 | A * | 7/1993 | Oltman | 417/12 |
| 6,176,683 | B1 * | 1/2001 | Yang | 417/44.1 |
| 6,536,326 | B2 | 3/2003 | Unger et al. | |
| 2003/0044286 | A1 * | 3/2003 | Kim | 417/63 |
| 2003/0161734 | A1 * | 8/2003 | Kim | 417/44.1 |
| 2003/0219341 | A1 * | 11/2003 | Dovey et al. | 417/44.1 |

OTHER PUBLICATIONS

International Search Report for International Application No. PCT/BR2004/000240 completed Apr. 18, 2005.
International Preliminary Report on Patentability for International Application No. PCT/BR2004/00240 completed Mar. 29, 2006.
Written Opinion of the International Searching Authority for International Application No. PCT/BR2004/000240 mailed Apr. 22, 2005.

* cited by examiner

*Primary Examiner* — Charles Freay
(74) *Attorney, Agent, or Firm* — Alston & Bird LLP

(57) ABSTRACT

The present invention relates to a system and to a method of controlling a fluid pump, as well as to a linear compressor and a cooler configured to calibrate the respective functioning at the time of the first use or in cases of problems caused by electric or mechanical failures. According to the teachings of the present invention, the fluid pump is provided with a piston-position sensing assembly, the electronic controller monitoring the piston displacement within the respective cylinder by detecting an impact signal. The impact signal is transmitted by the sensing assembly upon occurrence of an impact of the piston with the stroke end, the electronic controller successively incrementing the piston displacement stroke upon a trigger signal as far as the occurrence of the impact to store a maximum value of piston displacement.

31 Claims, 7 Drawing Sheets

FLUID PUMP CONTROLLING SYSTEM, A FLUID PUMP CONTROLLING METHOD, A LINEAR COMPRESSOR AND A COOLER

BACKGROUND OF THE INVENTION

The present invention relates to a system, a method of controlling a fluid pump, as well as to a linear compressor and a cooler provided with means for calibrating the respective functioning at the time of first use or in cases of problems caused by electric or mechanical disturbances throughout the useful life of these pieces of equipment.

A fluid pump, for instance, a linear compressor, is usually controlled by an electronic controller, which adjusts the voltage supplied to the motor that drives a piston in a cylinder where a gas or a liquid is compressed.

The piston is displaceable positioned within the cylinder, having a stroke moving up to a stroke end, where the valve plate in the case, for example, of linear compressors is found One of the problems found in these types of equipments lies in the fact that the piston may impact (or collide) with said stroke end, and may cause noises or even break the equipment. So, it is necessary to control the position of the piston, as well as the occurrence of collisions thereof with the respective stroke end.

DESCRIPTION OF THE PRIOR ART

Usually, the systems of the prior art foresee the monitoring of collisions during the use of the fluid pumps, so as to prevent the above-cited problems.

Moreover, in order to achieve maximum efficiency or maximum capacity of pumping fluids, the pump piston has to reach the maximum displacement possible. With the piston functioning very close to the respective stroke end, for the system to operate safely in this condition, it is necessary to use displacement sensors having good precision, and it is further necessary to calibrate the system, which may be difficult to do on an industrial scale.

In the case of sensors having low precision, it is necessary to decrease the value of the maximum possible displacement of the piston. In this way, the piston will operate at a longer distance from the stoke end, thus increasing the safety of the fluid pump, but impairing the respective efficiency and the maximum capacity.

Another problem refers to the gain and offset leeway. The problem is particularly pertinent, since, for instance, by using an accelerometer-type sensor, in addition to the stroke, there are other factors that influence the acceleration, for example, the discharge and suction pressures of the fluid pump. This is because, when these factors change during the functioning, the response of the sensor will also change.

In certain types of sensor, there may be, for instance, influence of the variation in temperature, which makes them inadequate for measurement in cases where it is necessary to calibrate a fluid pump.

Technically, a sensor may be, in general, approximated to the following equation.

$$Y=m\times X+b$$

wherein

Y is the stroke (output signal of the sensor);

X is the measured physical magnitude (inlet of the sensor);

m is the gain or multiplicative factor; and b is the offset or additive factor.

On the basis of this equation, it can be noted that the response of the sensor will vary if the factors m and b vary (for instance, some variation in temperature, pressure), depending on the type of sensor.

Although the previous techniques provide control with regard to the positioning of the piston and the occurrence of collisions, none of them foresee a calibration necessary in order to able the controlling system be employed on a large scale in the manufacture of fluid pumps.

This problem is due to the fact that the electronic and mechanical components used in manufacturing fluid pumps, in general, have levels of tolerance, so that a fluid pump hardly or never has characteristics identical to one of another pump manufactured by the same specifications.

The consequence is that, when manufacturing fluid pumps provided with systems for monitoring the position and the impact of the piston, it will always be necessary to foresee a calibration step during the manufacture or assembly of the fluid pump, so as to make the final adjustment for each equipment and, in this way, eliminate the possible imprecisions resulting from the tolerances of the components, as mentioned before.

Evidently, the need to employ an additional calibration step in a manufacturing or assembling line results in significant losses of time and, consequently, financial losses.

One of the ways to control the movement of pistons in compressors is described in document U.S. Pat. No. 6,536,326. According to the teachings of this previous technique, the monitoring of piston collisions, for instance, by means of a microphone, is foreseen. When an impact occurs, a disturbance signal is generated, which is fed to an electronic control that will actuate on the piston displacement, thus preventing the occurrence of further collisions. The system also foresees the storage of a maximum value of piston displacement from the occurrence of a collision.

In spite of preventing the occurrence of collisions, according to the teachings of this document U.S. Pat. No. 6,536,326, it is not possible to adjust the maximum value of piston displacement, so that the step and calibration in the manufacturing and assembling line continues to be necessary.

BRIEF DESCRIPTION AND OBJECTIVES OF THE INVENTION

The present invention relates to a system, a method of controlling a fluid pump, as well as a linear compressor and a cooler having a control preferably with an electronic circuit for treating the signal from the displacement sensor, such a circuit having an output for informing the maximum piston displacement in the fluid pump, and another output for informing the occurrence of a mechanical impact of the piston at the end of the stroke (or to foresee a mechanical impact or collision). The control also foresees an algorithm/calibration method capable of adjusting the maximum limit of piston displacement with the information from the circuit of treating the signal from the displacement sensor.

The calibration method may be carried out whenever the system is turned on or whenever a failure occurs. One may also establish a periodic calibration with a predefined time, this time being dimensioned according to the characteristics of the sensor that is being used.

Further, in order to have maximum efficiency of the fluid pump, the piston should work as close to the stroke end as possible. The ideal value would be to operate it at a zero distance from the stroke end, but since this is not possible due to the errors of tolerance and oscillations in the piston stroke, the system and the method of the present invention enable, from a self-calibration, to eliminate the sources of error, which allows the piston to come as close as possible to the stroke end. When this is not possible and the piston needs to work at a longer distance from the stroke end, then this compressor will be used under its maximum capacity. With this safety distance of the piston from the stroke end corresponds to a volume, called "dead volume", a portion of gas stored in this dead volume is simply compressed and decompressed during the operation of the compressor, generating losses. The ideal situation is that the whole gas should be pumped and that no portion of the gas remains stored in the dead volume.

The present invention has the following objectives:

- controlling the piston stroke in a fluid pump, allowing the piston to advance as far as the end of its mechanical stroke, without allowing collision of the piston at the cylinder top and further, reducing to a minimum the value of the "dead volume" within the cylinder;
- implementing an automatic calibration system during the normal operation of the fluid pump, which avoids the calibration procedure during the manufacturing or assembling process and is capable of operating the piston with the shortest distance possible from the respective stroke end;
- make feasible the use of less precise sensors or with gain and offset leeway, without impairing the performance of the system (efficiency and maximum capacity);
- optimizing the fluid pump in efficiency and capacity;
- implementing a simple solution for industrial large scale production.

The objectives of the present invention are achieved by means of a control system for controlling a fluid pump, the fluid pump comprising a piston displaceably positioned in a cylinder, the cylinder having a piston-displacement stroke and the cylinder having a stroke end, the system comprising a sensing assembly measuring the behavior of the piston and an electronic controller associated to the sensing assembly, the electronic controller monitoring the piston displacement within the cylinder by detecting an impact signal, the impact signal being transmitted by the sensing assembly upon occurrence of a collision of the piston at the stroke end, the impact signal being transmitted by the sensing assembly to the electronic controller, the electronic controller successively incrementing the piston-displacement stroke from a trigger signal until the occurrence of the collision, to store a maximum value of piston displacement.

The objective of the present invention are also achieved by means of a fluid pump controlling method, the fluid pump comprising a piston displaceably positioned in a cylinder, the cylinder having a piston displacement stroke and the cylinder having a stroke end, the method comprising the steps of turning on the fluid pump, causing the piston to displace in the cylinder; successively increment the piston stroke as far as the occurrence of an impact thereof with the stroke end, monitoring the piston stroke for a stabilization time between the successive increments of the stroke, and decrementing the piston stroke if an impact occurs during the stabilization time.

Further, a of carrying out the teachings of the present invention is to provide a control system for controlling a fluid pump, which comprises a sensing assembly for sensing the piston position and an electronic controller associated to the sensing assembly, the electronic controller monitoring the piston displacement within the cylinder by detecting an impact signal, the impact signal being transmitted by the sensing assembly upon occurrence of a collision of the piston at the stroke end, the impact signal being transmitted by the sensing assembly to the electronic controller, the electronic controller successively incrementing the piston displacement stroke form a trigger signal until the occurrence of the collision in order to store a maximum value of piston displacement, and monitoring the piston displacement within the cylinder and preventing displacement as far as the maximum value of piston displacement.

Another way of carrying out the teachings of the present invention is a method of controlling a fluid pump, which comprises steps of turning on the fluid pump, causing a displacement of the piston within the cylinder; successively incrementing the piston stroke until the occurrence of an impact thereof at the stroke end, monitoring the piston stroke for a stabilization time, and decrementing the piston stroke if an impact occurs during the stabilization time.

The objectives of the present invention are further achieved by means of a linear compressor comprising piston displaceably positioned in a cylinder, the cylinder having a piston-displacement stroke and the cylinder having a stroke end, the system comprising a sensing assembly for sensing the piston position, and an electronic controller associated to the sensing assembly, the electronic controller monitoring the piston displacement within the cylinder by detecting an impact signal, the impact signal being transmitted by the sensing assembly upon occurrence of a collision of the piston with the stroke end, the impact signal being transmitted by the sensing assembly to the electronic controller, the electronic controller successively incrementing the piston displacement stroke until the occurrence of the collision in order to store a maximum value of the piston displacement.

Further, the objectives of the present invention are achieved by means of an environment cooler, which comprises a control system for controlling a fluid pump, the fluid pump comprising a piston displaceably positioned in a cylinder, the cylinder having a piston-displacement stroke and the cylinder having a stroke end, the system comprising a sensing assembly and an electronic controller associated to the sensing assembly, the electronic controller monitoring the piston displacement within the cylinder by detecting an impact signal, the impact signal being transmitted by the sensing assembly upon occurrence of a collision of the piston at the stroke end, the impact signal being transmitted by the sensing assembly to the electronic controller, the electronic controller successively incrementing the piston-displacement stroke from a trigger signal until the occurrence of the collision, to store a maximum value of piston displacement.

BRIEF DESCRIPTION OF THE DRAWINGS

The present invention will now be described in greater detail with reference to an embodiment represented in the drawings. The figures show.

DETAILED DESCRIPTION OF THE FIGURES

Figure 1:
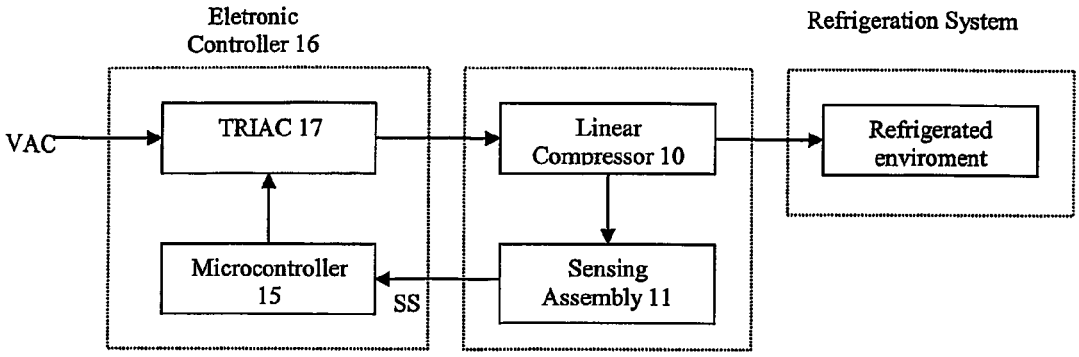
FIG. 1 represents a block diagram of the system of the present invention.
Figure 2:
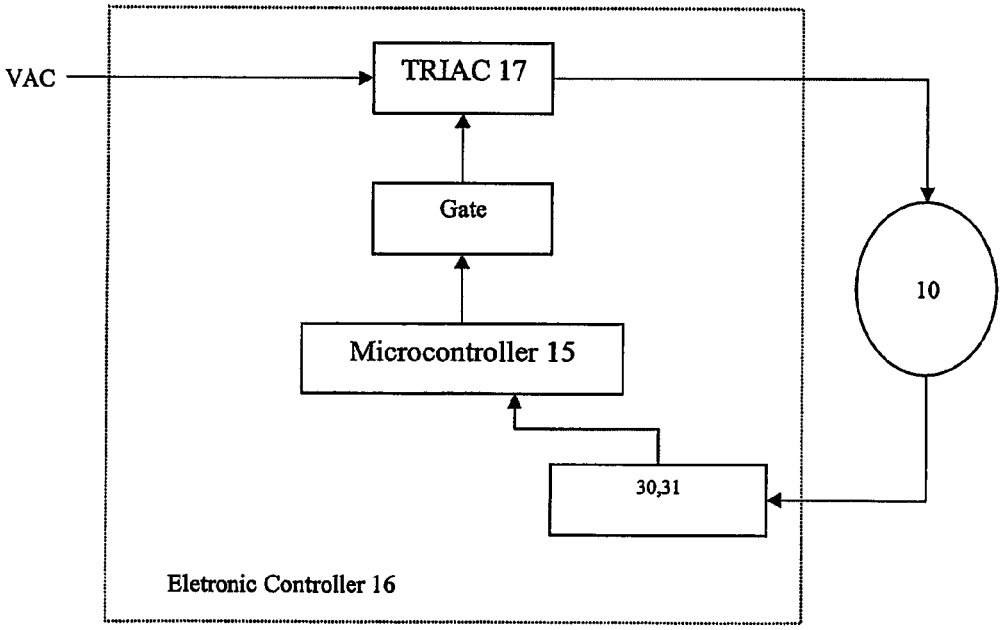
FIG. 2 represents a block diagram of the system of the present invention, applied in controlling a linear compressor.

As can be seen in FIG. 1, the use of the system of the present invention on cooling systems where linear compressors 10' are used is exemplified.

The teachings of the present invention may be employed on any type of fluid pumps, the application being particularly relevant in the cases of linear compressors, since these pieces of equipment need a strict calibration to prevent problems during their use.

A control system for controlling a fluid pump is usually controlled by an electronic controller 16, preferably comprising a microcontroller 15 that controls the voltage supplied to an electric motor (not shown), which drives the fluid pump 10.

The voltage supplied to the electric motor is controlled by means of the electronic controller 16 through a gate from the control of conduction time of a set of switches 17 (preferably TRIACS) and, consequently, the movement of the fluid pump 10. In the particular application illustrated in the figures, the capacity of the compressor 10' is controlled in order for the cooled environment 18 to remain within the desired conditions.

The fluid pump 10 comprises a piston (not shown), which is displaceably positioned within the cylinder, the cylinder having a piston displacement stroke as far as the stroke end, where, for instance, the valve plate is located in linear compressors 10'.

In order for the system to operate in ideal conditions, the piston should move as close as possible to the respective stroke end, without, however, colliding against it, and without being too far from this point, since in this case the efficiency of the pump is lower.

Constructive Characteristics in the Fluid Pump 10:

Sensing Assembly

According to the teachings of the present invention, a sensing assembly 11, which comprises an impact sensor 35 and a position sensor 36 to sense the piston displacement stroke, should be provided.

The impact sensor 35 should be in a position to detect a collision of the piston at the stroke end and generate an impact signal to the electronic controller 16.

One of the forms of sensor that may be used in the system of the present invention is the sensor described in patent document BR0301969-1, filed on May 22, 2003, which describes an accelerometer capable of detecting a collision of the piston against the stroke end.

Other types of sensor may be used, as long as they detect the collision or the imminence of a collision, thus preventing an impact signal to the electronic controller 16.

For instance, one can make use of a sensor as described in documents BR 0001404-4 and BR 0200989-0. In the two cases the impact sensors are capable of generating an impact signal corresponding to an impact or a displacement very close to the piston stroke end.

Operation of the Sensor:

In order to implement the system of the present invention, one should operate the piston by incrementing its stroke, until an impact is felt from the sensing assembly 11 and, particularly, from the impact sensor 35.

As soon as the piston collides against the stroke end, or touches the impact sensor 35, it can be concluded that the piston has reached a maximum displacement value, and this value may be stored in the electronic controller 16.

The system should be designed so that the maximum value of piston displacement corresponds to a displacement of maximum efficiency of the fluid pump 10, in order to have, at the same time, an optimum efficiency of the pump and a minimum risk of impact of the piston with the stroke end.

Since both the electronic components and the mechanical components used in manufacturing each fluid pump 10 have levels of tolerance, each equipment will have values of stroke end and maximum value of displacement different from each other, so that the calibration until a point of impact eliminates the tolerances found in fluid pumps in general.

With regard to the frequency with which the above procedure is applied, it may be performed whenever the fluid pump 10 is started, for instance, in the case of coolers, whenever the compressor 10' is turned on. It may be opted to carry out the procedure with a determined frequency, for example, daily or with the frequency necessary to prevent impact problems during the use of the fluid pump 10. The calibration may be started from an external signaling, which may be foreseen for beginning the procedure, whenever an electrical disturbance occurs in the network, for instance.

In order to implement this, the electronic controller 16 must simply generate a trigger signal from the occurrence of a problem with the fluid pump 10, so as to initiate the calibration procedure.

Preferably, one opts for initiating the fluid pump 10 with a minimum piston displacement stroke from a trigger signal, that is to say, upon occurrence of a problem or when the motor is turned off.

After calibration, that it so say, once the maximum value of piston displacement is obtained, one should store a value obtained at the electronic controller 16. With this value, one should operate the system for simultaneously monitoring the piston stroke and its impact, by adopting a maximum value obtained by means of the calibration (or self-calibration, since the system finds the maximum point for each fluid pump) of the system in monitoring the piston stroke.

The monitoring may be effected in various ways. For instance, one may chose to monitor the piston position on the basis of the teachings of patent case BR9907432-0, the description of which is incorporated herein by reference. So, according to the teachings of the present invention, it should be foreseen to store the maximum value of piston displacement within the cylinder of the fluid pump 10 and then evaluate whether the piston tends to collide or not, decrementing the value of the voltage fed to the motor that drives the fluid pump 10, thus preventing the piston from colliding.

The systems of monitoring the piston position described in these documents will have as a basis a maximum value of piston displacement and, with this value, they may operate so as to prevent excessive piston displacement.

With the simultaneous monitoring of the piston stroke and impacts, one obtains greater safety in this operation, in addition to a greater efficiency of the fluid pump. In particular, the monitoring of impact has two functions: the first one, during the calibration process, is to inform when the piston has reached the maximum limit of displacement, as well as to adjust the piston stroke; the second one is to monitor the normal functioning of the fluid pump in order to prevent impacts due to failures.

Figure 9:
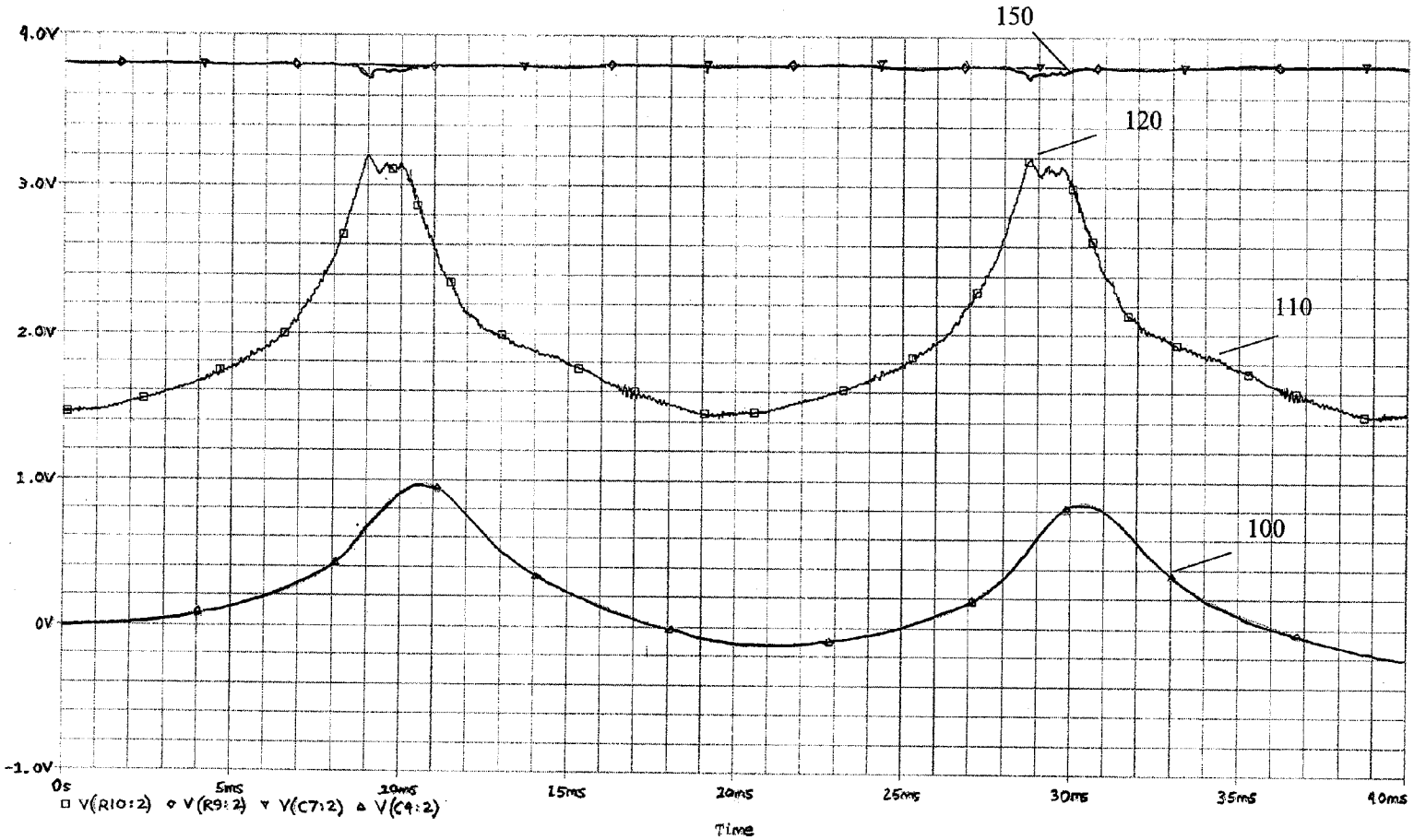
FIG. 9 represents a graph of an average made on a linear compressor provided with a system according to the present invention, the graph illustrating a situation in normal functioning.
Figure 10:
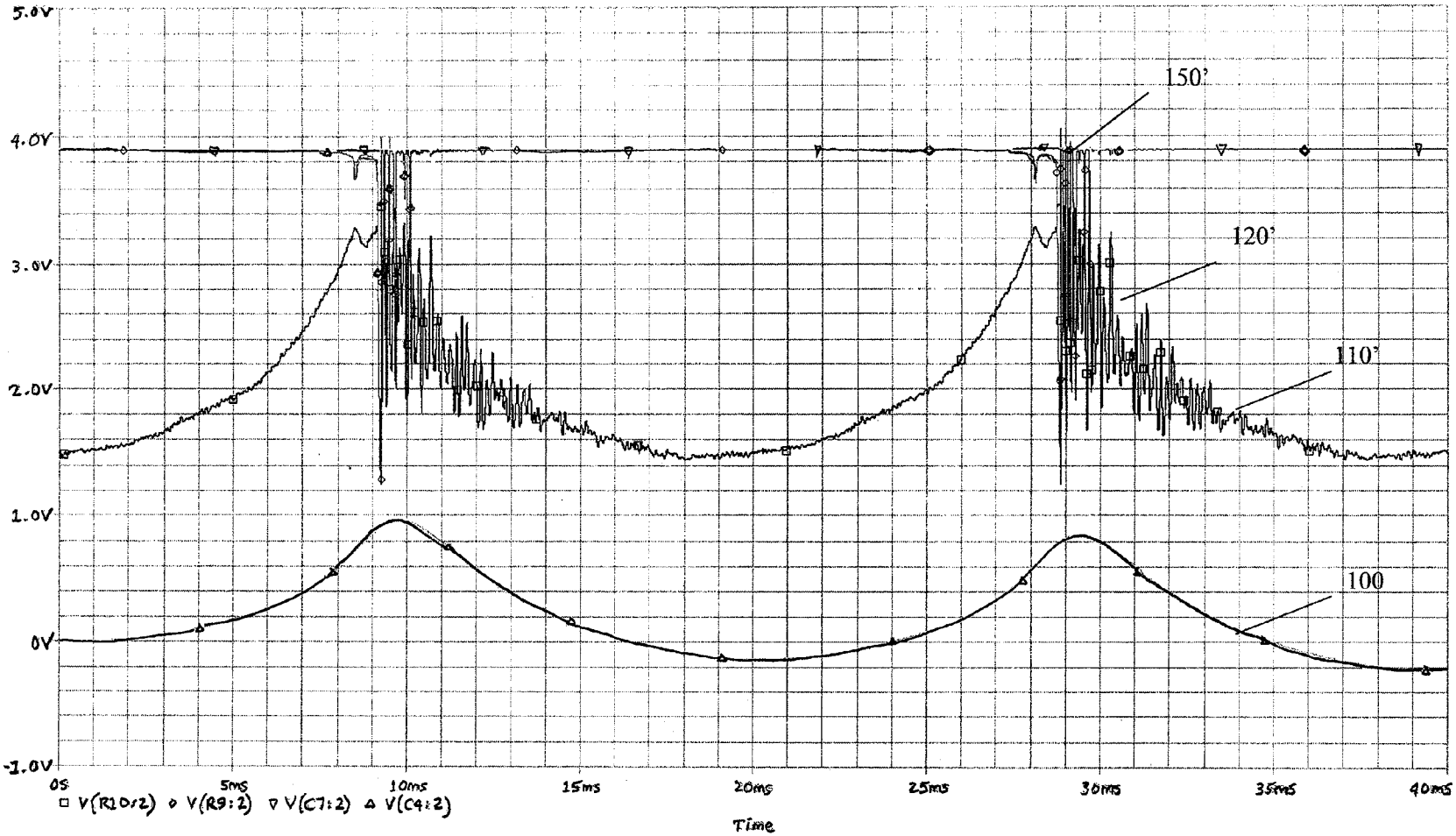
FIG. 10 represents a graph of an average made on a linear compressor provided with a system according to the present invention, the graph illustrating a situation in functioning with impact.

Interpretation of the Measures of the Sensing Assembly 11:

As can be seen in FIGS. 9 and 10, the piston movement within the cylinder presents a curve corresponding to the displacement measured by means of a position 36 and impact 35 sensor.

FIG. 9 illustrates a situation where the piston operates without the occurrence of impacts. As can be seen, in this situation, the signal output from the position sensor 36 (curve 110) presents a maximum piston displacement without the occurrence of noises (see indication 120). The curve 100 indicates the signal of piston displacement, after passage through filtering circuit 42, while the curve 150 shows that there is no impact of the piston, since there is measured signal.

FIG. 10 illustrates a situation where the piston operates with occurrence of impact. As can be seen, in this case the output of the sensing assembly 11 (110') generates a noise (see indication 120'), which may be interpreted by the electronic controller 16, generating the signal 150' after the first filtering circuit 40, and may even be directly connected to one of the ports of the microcontroller 15 or equivalent. The curve 100' is obtained after the second filtering circuit 42 (low pass circuit) and represents the signal of piston displacement.

Figure 3A:
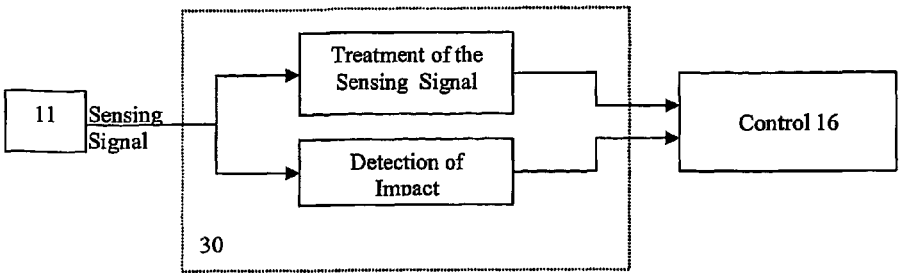
FIG. 3*a* represents a block diagram of the system of the present invention in the use with a single sensor.
Figure 3B:
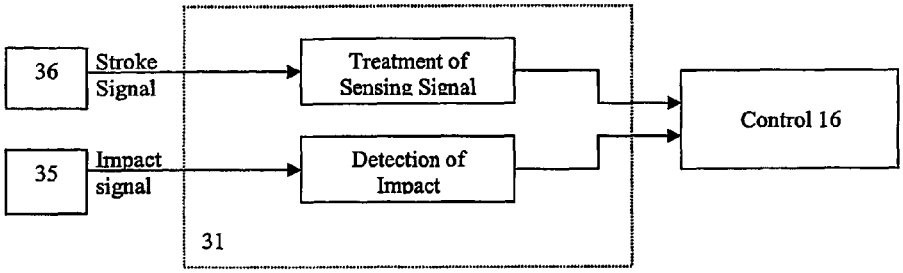
FIG. 3*b* represents a block diagram of the system of the present invention in the use with two sensors.
Figure 4:
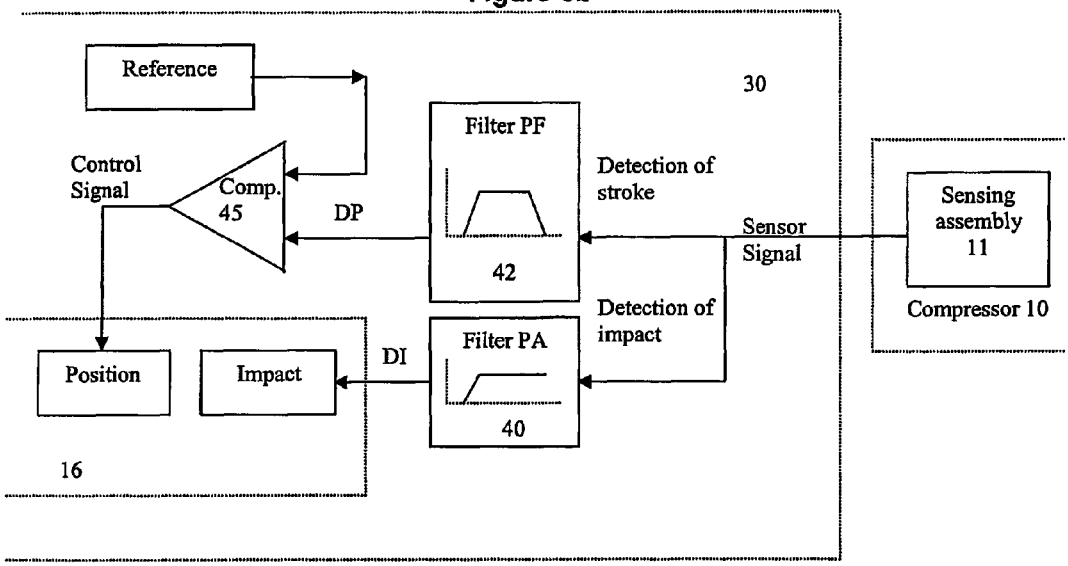
FIG. 4 represents a detail of the block diagram of the system of the present invention when a single sensor is used.

System of Measuring and Interpreting the Measures of the Sensing Assembly 11:

As can be seen in FIGS. 3*a*, 3*b* and 4, the signals from the sensing assembly 11 are interpreted by means of a signal treatment module 30, 31, which may be carried out in two constructive ways, namely:

By Using a Single Sensor:

Since the signal from a sensor is capable of monitoring piston position and simultaneously piston impacts, that is, the behavior of the piston, the latter presenting now a low-frequency signal (monitoring of the piston position) now a high-frequency signal (impact situation), the separation of these signals should be foreseen so that the measures can be interpreted by the electronic controller 16.

For this purpose, the system of the present invention should be provided with a signal treatment module 30, which comprises a first filtering circuit 40 and a second filtering circuit 42.

An inductive-type sensor may, for example, be chosen. With this embodiment, the sensing assembly 11 will generate a measurable wave of piston displacement, as well as an impact signal, as soon as the piston collides with the respective stroke end. In this case, the signal treatment module should be adequate for separating the signals generated by this type of sensor.

Figure 6:
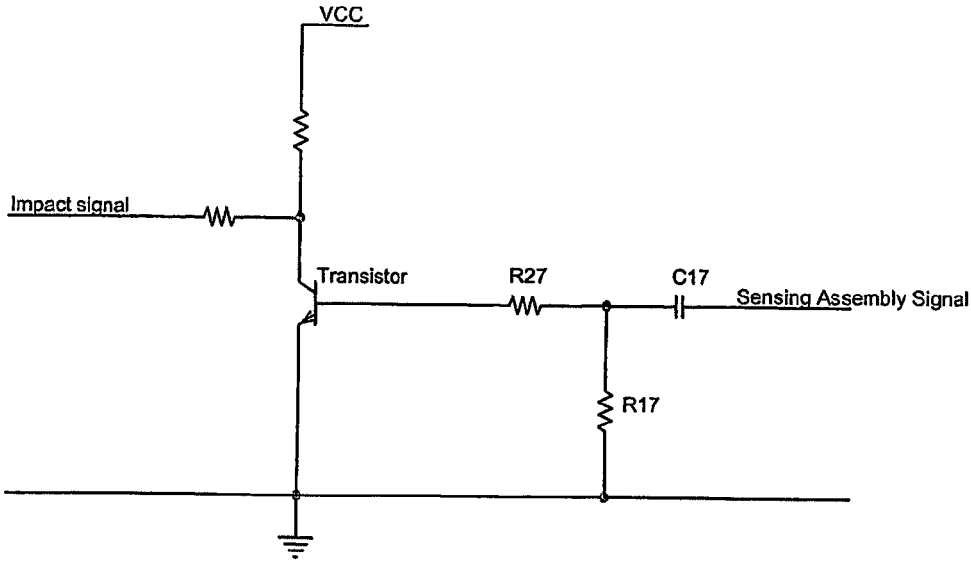
FIG. 6 represents an electric diagram of one of the ways to carry out the embodiment of the first filtering circuit.

As can be seen in FIGS. 4 and 6, the first filtering circuit 40 is of the high-pass filter. With this embodiment, the filter eliminates the signal read by the sensing assembly 11 at the low frequencies, that is, the signal corresponding to the piston displacement, allowing only the signal corresponding to an impact to pass to the electronic controller 16.

The second filtering circuit 42 is of the low-pass type, so as to eliminate the high frequencies from the signal read in the case of a piston impact. The signal read in this case will correspond to a signal of piston displacement within the cylinder, this signal being transmitted to the electronic controller 16 and interpreted by the latter.

FIG. 6 exemplifies one of the embodiments of the first filtering circuit 40. In this embodiment, the assembly formed by the resistor $R_{17}$ and the capacitor $C_{17}$, forms the high-pass filter and should be configured, for instance, for cutting frequencies below 5 KHz in the cases where the teachings of the present invention are employed on linear compressor. The resistor $R_{27}$ has the function of limiting the current transmitted on the basis of a transistor 77, which amplifies the signal read by the sensing assembly 11.

Figure 5:
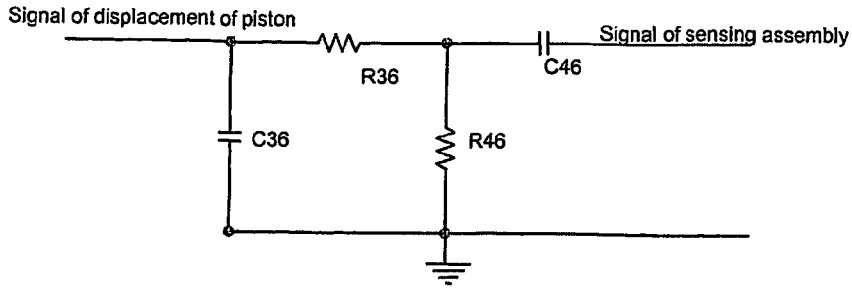
FIG. 5 illustrates an electric diagram of one of the ways to carry out the second filtering circuit.

FIG. 5 exemplifies one of the embodiments of the second filtering circuit 42. In this embodiment, the assembly formed by the resistor $R_{46}$ and the capacitor $C_{46}$ actuates as high-pass filter, while the assembly formed by the capacitor $C_{36}$ and the resistor $R_{36}$ forms a low-pass filter, the superposition of the two assemblies will result in a low-pass filter. In the cases where the teachings of the present invention are employed on linear compressors 10', it may be opted to configurate such filters to cut frequencies lower than 5 Hz and frequencies higher than 500 Hz from the signal read by the sensing assembly 11. In this way, the output of the second filtering circuit 42 will correspond to the piston displacement.

The signals read by the sensing assembly 11 and treated by the first and second filtering circuits 40, 42 are transmitted to the electronic controller 16, which will actuate to prevent piston impact.

The signal treated by the first filtering circuit 40 may be directly fed to the electronic controller 16, since the latter may be interpreted in a binary way. This can be seen in FIG. 7, where the signal of the sensing assembly 11 signalizes that, when the piston passes by a maximum stroke point, an impact may occur or is imminent, and its displacement stroke should be decreased.

The signal treated by the second filtering circuit 42 has a variable amplitude, since it corresponds to the piston displacement within the cylinder. In this way, this signal should be passed through a comparator 45 before being transmitted to the electronic controller 16. The comparator 45 is connected to a reference voltage, which should be adjusted according to the characteristics of the fluid pump 10. Optionally, an A/D converter instead of the comparator 45 may be used.

Figure 7:
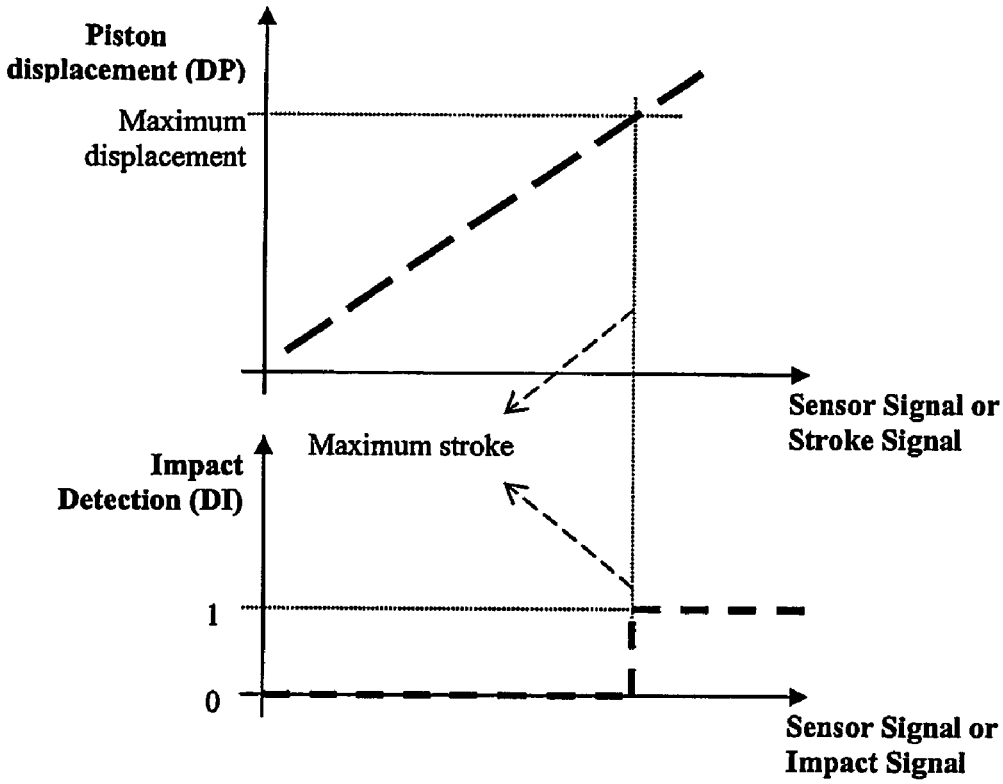
FIG. 7 represents a graph of the signal read on the sensing assembly of the present invention.

As can be seen in FIG. 7, once the sensing assembly 11 has detected a value of maximum stroke, one should signalize this situation to the electronic controller 16.

In order to implement the sensing assembly by using, for example, a PZT-type or piezoelectric sensor, when the piston collides with the respective stroke end, high-frequency (above 5 kHz) components arise, and the first filtering circuit 40 should select only these high-frequency components of the signal generated by the sensing assembly 11, since these identify the mechanical impact of the piston with the cylinder top or stroke end. On the other hand, the second filtering circuit 42 should be adjusted to select the frequency of functioning of the system (50 or 60 Hz) and eliminate DC or high-frequency components, since the information of the stroke will be in the operation frequency. Evidently, the comments relating to the present example of PZT sensor should not be taken as a limiting factor for the teachings of the present invention, since other types of sensor may be used to implement the sensing assembly 11, and there may exist, for instance, other types of filters.

By Using Two Sensors:

According to this variation, it may be opted to provide a fluid pump 10 with two sensors with different functions: an impact sensor 35 and a piston-position sensor, the two of them providing a signal to be interpreted by the electronic controller 16.

In this embodiment, the signal treatment module 31 will receive signals from each of the sensors 35, 36, just as illustrated in FIG. 3*a*, and one should proceed in the say way as describes in the option with the use of a single sensor to transmit the information to the electronic controller 16.

One of the ways of interpreting the signal read by the position sensor is described in patent document BR9907432-0, but other forms of monitoring may be used.

Type of Sensor and its Respective Arrangement on a Fluid Pump 10:

As an impact sensor, an accelerometer-type sensor, as already mentioned before can be used for example. In this case, the impact sensor 35 should be associated to the cylinder of the fluid pump 10 and, preferably, one should fix such an accelerometer together with the cylinder of the fluid pump 10, so that the piston impacts can be sensed.

The position sensor 36 may be embodied, for example, by means of magnetic sensors. These types of sensors emit a magnetic field that suffers interference from the approach of the piston, so as to generate a wave measurable by the electronic controller 16. This position sensor 36 may be arranged, for instance, within the cylinder of the fluid pump.

Fluid Pump 10 Controlling Method

Figure 8:
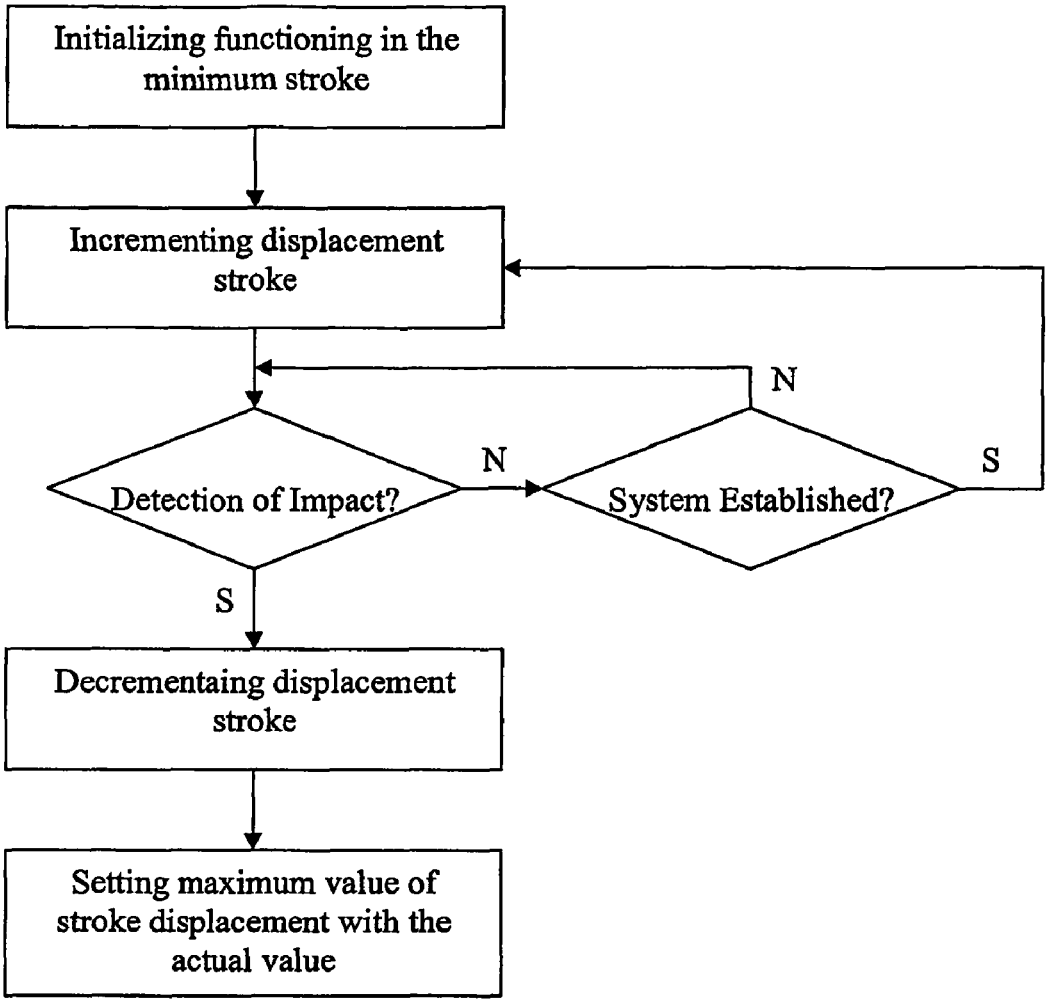
FIG. 8 represents a flow diagram of the method/self-calibration routine of the system of the present invention.

In order to operate the system of controlling the fluid pump 10 and the linear compressors, or even coolers that may comprise refrigerators or air-conditioning systems, the following steps, which are illustrated in FIG. 8 should be followed.

Whenever the fluid pump 10 receives a trigger signal or whenever it is started, as described before, one should start the fluid pump 10 by causing a piston displacement within the cylinder with a minimum stroke, and successively incrementing the amplitude of displacement.

Then, piston stroke should be monitored in order to detect possible impacts and, if the latter does not occur, a stabilization time should be awaited to conclude whether the system is stabilized, that is to say, to evaluate whether impacts will not occur during this period.

With regard to the term "impact", it should be considered that it may be an imminent impact of the piston, since this will depend upon the type of sensor used to monitor such a step. In the cases of the use of an accelerometer-type sensor, the piston impact with the stroke end will correspond to its collision. On the other hand, in the cases where one uses, for example, touch-type sensors, as described in documents BR00014044 and BR0200898-0, or even in the case of magnetic sensors, in the situation of impact there will not be real collision of the piston with the respective stroke end, but only the imminent impact as described above.

After the step of stabilization time, if the system is stabilized, that is, if no impacts take place during the stabilization time, the piston stroke should be again incremented and this routine should be repeated until an impact is detected.

The value of the stabilization time will depend on the type of fluid pump to be used. In the case of use on linear compressor, this stabilization time may be on the order of magnitude of a few seconds up to a few minutes, the typical value being of ten seconds. The correct designation of the magnitude of the value of the stabilization time may be determined as a function of a monitoring of the piston stroke. Thus, a stabilization time of a magnitude determined by the piston stroke to be monitored by an external system can be applied. The piston stroke may be monitored and only an increment in the displacement magnitude effected when one is certain that no further impacts will occur.

In a following step, after detection of an impact, the piston stroke should be decremented, and thus the maximum value of piston stroke on the fluid pump 10 is established. After this step, the fluid pump 10 is operated in a constant way, provided that no electrical or mechanical failures occur, as described above, when the pump with the minimum stroke should be started.

In order to be certain that, upon decrementing the displacement stroke, the piston will then displace with a safe and at the same time optimum displacement as far as the efficiency of the compressor is concerned, the value of maximum piston displacement should be stored in the electronic controller 16 and, from this moment, start monitoring the piston stroke with the value of maximum displacement obtained from the impact. It may be opted for decreasing the amplitude of piston displacement, for instance, in percentage.

In this regard, once the maximum value of piston displacement is known, the electronic controller 16 will no longer allow the fluid pump to be operated beyond this limit and, even so, if a further impact occurs, the electronic device 16 should recalibrate the system, that is to say, start the piston displacement at a minimum stroke, successively incremented. In order for this to be feasible, the system should always be functioning, not only during the calibration routine.

As mentioned above, the step of starting the fluid pump 10 with a minimum stroke can be carried out periodically and, in this way, constantly calibrate the fluid pump 10 to a maximum piston stroke.

Application to Linear Compressors:

As mentioned above, the control system for controlling a fluid pump 10, as well as the respective control method are particularly for applications involving linear compressors 10', since the latter are provided with a piston displaceably positioned in a cylinder, which has a piston displacement stroke and the cylinder having a stroke end.

The application in these cases is particularly useful, since the piston oscillates freely within the cylinder and the tolerances of the assembling step should be adjusted.

The advantages of the present invention result is that the tolerances of the electronic and mechanical components may be greater, since a calibration of the fluid pump 10 is foreseen whenever the equipment is turned on. In this way, the calibration step during the manufacture and assembly of the fluid pump 10 can be eliminated, which results in gains in time and, consequently, financial gains.

The possibility of automatic adjustment whenever a failure is detected also results in a safer fluid pump 10, when compared with those assembled according to the teachings of the present state of the art.

Moreover, as a calibration of the system has been foreseen, it is possible to use less precise sensors or sensors with leeway of gain and offset.

The optimization of the efficiency of the fluid pump 10 is significant, since the piston may operate close to the stroke end, which results in a maximum efficiency.

The possibility of using a single sensor monitoring simultaneously the piston displacement and the occurrence of impacts also results in economical gains, since, in addition to saving of components, the need to install more than one sensor on the fluid pump 10 is eliminated. And it is also possible to make integration with other piston-movement systems.

Preferred embodiments having been described, one should understand that the scope of the present invention embraces other possible variations, being limited only by the contents of the accompanying claims, which include the possible equivalents.

The invention claimed is:

1. A fluid pump controlling system comprising, a fluid pump (10) comprising a piston displaceably positioned in a cylinder, the cylinder having a piston displacement stroke and the cylinder having a stroke end, the fluid pump (10) being driven by an electric motor fed by electric voltage;

a sensing assembly (11) to measure the behavior of the piston, and an electronic controller (16) to control the electric voltage, the electronic controller (16) being electrically connected to the sensing assembly (11), the electronic controller (16) being arranged to monitor the displacement of the piston within the cylinder during operation by detecting an impact signal, the impact signal being transmitted by the sensing assembly (11) upon occurrence of an impact of the piston with the stroke end, the impact signal being transmitted by the sensing assembly (11) to the electronic controller (16), the electronic controller (16) being configured to cause a calibration impact by performing a calibration procedure comprising successively incrementing the piston displacement stroke by increasing the voltage fed to the electric motor, the voltage increment being controlled by a trigger signal until the occurrence of the calibration impact, and storing a maximum value of piston displacement corresponding to the piston displacement as far as the stroke end, wherein the calibration procedure is performed prior to operation and in response to receiving an impact signal during operation.

2. A system according to claim 1, wherein the maximum value of piston displacement corresponds to a displacement of maximum efficiency of the fluid pump (10).

3. A system according to claim 2, wherein the trigger signal is generated by the electronic controller (16) upon occurrence of a problem of the fluid pump (10).

4. A system according to claim 1, wherein the fluid pump (10) is actuated with a minimum piston displacement stroke.

5. A system according to claim 3, wherein the fluid pump (10) is actuated upon occurrence of the trigger signal.

6. A system according to claim 5, further comprising:

a first filtering circuit (40) electrically connected to the electronic controller (16), the first filtering circuit (40) being of the high-pass type, the impact signal read by the sensing assembly (11) being filtered by the first filtering circuit (40) and being fed to the electronic controller (16).

7. A system according to claim 6, wherein the sensing assembly (11) comprises an impact sensor (35) electrically connected to the cylinder of the fluid pump (10).

8. A system according to claim 7, wherein the impact sensor (35) comprises an accelerometer fixed together with the cylinder of the fluid pump (10).

9. A system according to claim 5, wherein the sensing assembly (11) comprises a position sensor (36) of the piston displacement stroke, the position sensor (36) being electrically connected to the electronic controller (16).

10. A system according to claim 4, wherein the sensing assembly (11) comprises a second filtering circuit (42), electrically connected with an electronic controller (16), the second filtering circuit (42) being of the low pass type, the signal read by the sensing assembly (11) being filtered by the second filtering circuit (42) and being fed to the electronic controller (16), the signal read being filtered by the second filtering circuit (42) and corresponding to a signal of piston displacement within the cylinder.

11. A system according to claim 10, wherein the signal of piston displacement within the cylinder is transmitted to the electronic controller (16), the electronic controller (16) preventing the piston displacement as far as the stroke end.

12. An environment cooler comprising a control system as defined in claim 1.

13. A fluid pump (10) controlling system comprising:

a fluid pump (10) comprising a piston displaceably positioned in a cylinder, the cylinder having a piston displacement stroke and the cylinder having a stroke end, the fluid pump (10) being driven by an electric motor fed by electric power, a piston-position sensing assembly (11), and an electronic controller (16) electrically connected to the sensing assembly (11), the electronic controller (16) monitoring the piston displacement within the cylinder during operation by detecting an impact signal, the impact signal being transmitted by the sensing assembly (11) upon occurrence of an impact of the piston with the stroke end, the impact signal being transmitted by the sensing assembly (11) to the electronic controller (16); the electronic controller (16) being configured to cause a calibration impact by performing a calibration procedure comprising successively incrementing the piston displacement stroke from a trigger signal until the occurrence of the calibration impact to store a maximum value of piston displacement, and monitoring the piston displacement within the cylinder and preventing displacement as far as the maximum value of piston displacement, wherein the calibration procedure is performed prior to operation and in response to receiving an impact signal during operation.

14. A system according to claim 13, wherein the electronic controller (16) prevents piston displacement as far as the stroke end by decrementing the level of voltage applied to the motor.

15. A system according to claim 14, further comprising:

a first filtering circuit (4) electrically connected to the electronic controller (16), the first filtering circuit (40) being of the high-pass type, the impact signal read by the sensing assembly (11) being filtered by the first filtering circuit (40) and being fed to the electronic controller (16).

16. A system according to claim 15, wherein the sensing assembly (11) comprises an accelerometer fixed close to the cylinder of the pump fluid (10), the impact signal being generated by the accelerometer.

17. A system according to claim 14, wherein the sensing assembly (11) comprises a position sensor (36) to sense the piston displacement, the position sensor being electrically connected to the electronic controller (16).

18. A system according to claim 14, wherein the sensing assembly (11) comprises a second filtering circuit (42), electrically connected to the electronic controller (16), the second filtering circuit (42) being of the low pass type, the signal read by the sensing assembly (11) being filtered by the second filtering circuit (42) and being fed to the electronic controller (16), the signal read being filtered by the second filtering circuit (42) and corresponding to a signal of piston displacement within the cylinder.

19. A fluid pump controlling method, the fluid pump (10) comprising a piston displaceably positioned in a cylinder, the cylinder having a piston displacement stroke, and the cylinder having a stroke end, wherein the method comprises the steps of:

subjecting the piston stroke in the cylinder to a calibration procedure until a calibration impact is detected, wherein the calibration procedure comprises successively incrementing the piston stroke to cause the calibration impact with the stroke end, the calibration procedure further comprising:

(a) monitoring the piston stroke for a stabilization time, (I) incrementing the piston stroke if no impact occurs during the stabilization time and repeating the step (a), or (II) decrementing the piston stroke if an impact occurs during the stabilization time; and (b) storing a value of the piston stroke determined in step (II)

controlling the piston displacement during operation by applying a maximum piston stroke length equal to the stored value.

20. A method according to claim 19, wherein, prior to the calibration procedure, a step of incrementing the piston stroke is performed.

21. A method according to claim 20, wherein, prior to the step of incrementing the piston stroke, the fluid pump (10) is started with a minimum piston displacement stroke.

22. A method according to claim 21, wherein the step of starting the fluid pump (10) with a minimum piston displacement stroke is carried out upon initiating the functioning of the fluid pump (10).

23. A method according to claim 22, wherein the step of starting the fluid pump (10) is carried out periodically.

24. A method according to claim 23, wherein the step of starting the fluid pump (10) is carried out upon occurrence of a failure.

25. A method according to claim 19, wherein, after the step (II), the piston stroke is operated in a constant way.

26. A method according to claim 25, wherein, after the step of operating the stroke in a constant way, storage of the value of the maximum piston displacement at the electronic controller (16) is performed.

27. A method according to claim 25, wherein, after the step of operating the stroke in a constant way, the piston stroke is monitored.

28. A fluid pump controlling method, the fluid pump (10) comprising a piston displaceably positioned in a cylinder, the cylinder having a piston displacement stroke and the cylinder having a stroke end, wherein the method comprises the steps of:

(a) turning on the fluid pump (10), causing the piston to displace in the cylinder;

(b) successively incrementing the piston stroke during a calibration procedure to cause an impact with the stroke end to determine and store a maximum value of piston displacement, (c) monitoring the piston stroke for a stabilization time between the successive increments of the stroke, (d) decrementing the piston stroke if an impact occurs during the stabilization time, and (e) controlling the piston displacement during operation by applying a maximum piston stroke length equal to the stored maximum value.

29. A method according to claim 28, wherein, in the step (a), the piston stroke of the fluid pump (10) is initiated with a minimum displacement stroke.

30. A method according to claim 29, wherein, after the step (d), the monitoring of the piston displacement is performed.

31. A linear compressor comprising a piston displaceably positioned in a cylinder, the cylinder having a piston displacement stroke and the cylinder having a stroke end, wherein the system comprises:

a piston-position sensing assembly (11), and an electronic controller (16) electrically connected to the sensing assembly (11), the electronic controller (16) monitoring the piston displacement within the cylinder during operation by detecting an impact signal, the impact signal being transmitted by the sensing assembly (11) upon occurrence of an impact of the piston with the stroke end, the impact signal being transmitted by the sensing assembly (11) to the electronic controller (16), the electronic controller (16) being configured to perform a calibration procedure comprising successively incrementing the piston displacement stroke to cause a calibration impact to determine and store a maximum value of piston displacement, wherein the calibration procedure is performed prior to operation and in response to receiving an impact signal during operation.

* * * * *